US005114128A

United States Patent [19]

Harris, Jr et al.

[11] Patent Number: 5,114,128

[45] Date of Patent: May 19, 1992

[54] PROCESS AND APPARATUS FOR PERSONALIZING MAGAZINES, BOOKS AND OTHER PRINT MEDIA

[75] Inventors: William H. Harris, Jr, New York, N.Y.; William E. Nussbaum, Chevy Chase, Md.; Michael J. Armstrong, Arlington, Va.; Victor H. Deming, Washington, D.C.; John E. Brink, Stamford, Conn.

[73] Assignee: U.S. News & World Report, L.P., Washington, D.C.

[21] Appl. No.: 661,298

[22] Filed: Feb. 27, 1991

[51] Int. Cl.[5] ..... B41F 13/54

[52] U.S. Cl. ..... 270/11; 270/54; 270/55; 270/58; 270/53

[58] Field of Search ..... 270/1.1, 53, 54, 55, 270/56, 57, 58

[56] References Cited

U.S. PATENT DOCUMENTS

| | | | |
|---|---|---|---|
| Re. 31,710 | 10/1984 | Jackson | 270/57 |
| 3,796,487 | 3/1974 | Voorhees | 355/77 |
| 3,819,173 | 6/1974 | Anderson et al. | 270/54 |
| 3,917,252 | 11/1975 | Harder et al. | 270/58 |
| 4,027,142 | 5/1977 | Paup | 270/1.1 |
| 4,121,818 | 10/1978 | Riley et al. | 270/54 |
| 4,149,711 | 4/1979 | Jackson | 270/57 |
| 4,395,031 | 7/1983 | Gruber et al. | 270/54 |
| 4,493,482 | 1/1985 | Valenti et al. | 270/12 |
| 4,500,083 | 2/1985 | Wong | 270/54 |
| 4,574,692 | 3/1986 | Wahli | 270/55 |
| 4,582,312 | 4/1986 | Abrams | 270/1.1 |
| 4,768,766 | 9/1988 | Berger et al. | 270/58 |
| 4,789,147 | 12/1988 | Berger et al. | 270/1.1 |
| 4,989,850 | 2/1991 | Weller | 270/1.1 |
| 4,989,852 | 2/1991 | Gunther, Jr. | 270/54 |
| 5,013,019 | 5/1991 | Samuels | 270/1.1 |

*Primary Examiner*—Edward K. Look
*Assistant Examiner*—Therese M. Newholm
*Attorney, Agent, or Firm*—Nixon & Vanderhye

[57] ABSTRACT

Method and apparatus for incorporating pre-personalized signatures within magazines, books, catalogs, etc. which are intelligently matched to recipient name and address information printed on the covers of the magazines, books, etc. In one embodiment, pre-personalized signatures are printed off-line and later supplied to a signature feeder in the bindery line. Before or after deposit on the bindery chain conveyor, coded indicia on the pre-personalized signatures are machine read and processed through a control processor and related storage memory for locating and printing recipient name and address information on the magazine cover, matched to the pre-personalized signature.

45 Claims, 4 Drawing Sheets

PROCESS AND APPARATUS FOR PERSONALIZING MAGAZINES, BOOKS AND OTHER PRINT MEDIA

BACKGROUND AND SUMMARY OF THE INVENTION

This invention relates broadly to the production of print media such as magazines, books, catalogs and the like, and more specifically, to the application of personalized information on selected signatures of the magazine, and the coordination or matching of the personalized signatures with subscriber name and address information on the cover.

For purposes of this disclosure, reference will hereinafter be made to "magazine" or "magazines" with the understanding that the term is to be considered generic to magazines, books, catalogs and the like.

In a typical magazine assembly system, either a saddle stitch (also known as a saddle wire or inserter binder) or perfect binding (also known as patent, square back, or, in one variation, as side wire binding) bindery line is employed. On a saddle stitch bindery line, preprinted signatures are deposited in proper sequence on a bindery chain conveyor which carries the signatures to a series of processing stations for functions such as calipering, rejection, stitching, trimming, and labeling. Individual signatures are introduced onto the chain from hoppers usually located above and to one side of the chain. Each hopper has a stack of identical signatures. Each signature generally comprises a folded sheet of paper, or a preassembled group of sheets, which will be supported on the bindery chain along a center fold line. Each signature generally comprises four or more printed pages in the finished magazine. For standard magazine production, i.e., where all magazines assembled on the bindery line are identical, each hopper deposits its respective signature onto the bindery chain, as each copy of the magazine being assembled passes by on the chain underneath.

On a perfect binding bindery line the process is similar, the primary differences being that each hopper deposits its respective signature flat onto a moving belt conveyor rather than hanging them onto a moving chain conveyor, that the signatures are assembled in a side-by-side fashion adjacent to the other signatures rather than in a nested fashion within the other signatures, and that the signatures and covers are bound together with glue rather than wire staples.

The present invention is broadly applicable to both the saddle stitch and perfect bindery processes. The specific descriptions used as examples herein will focus on the more common saddle stitch bindery process.

It is often desirable to customize magazines by including or excluding certain signatures based on known characteristics of the recipient. For example, a signature containing articles or advertising relating to women's apparel might be included in those magazines addressed to female recipients and excluded from those magazines addressed to male recipients. Customization of this type is currently a widespread practice in the print media field, and is generally known as selective binding. In selective binding, the various hoppers are fired selectively in accordance with a master control program, which then addresses each selectively-assembled magazine with the appropriate address information.

It is also often desirable to personalize magazines by printing information specific to the individual recipient inside the magazine. For example, an advertising page in the magazine might be personalized with the name of the recipient and the location of the dealer closest to the recipient's address. Personalization of this type is also widely used in the print media field, and is generally known as on-line personalization or ink-jet personalization—a term derived from the printing device customarily employed. In on-line personalization, non-contact printing heads (such as the ink jet type) mounted on-line in the bindery line print personalized information on each magazine as it is being assembled and bound.

In some instances, it is also desirable to combine personalization and customization techniques. For instance, male recipients might be selected to receive signatures with advertising for pick-up trucks and female recipients might receive signatures with advertising for station wagons, while both advertisements might be personalized with the recipient's name and the location of the nearest dealer.

The patent literature describes a number of complex systems for customizing and personalizing magazines. For example, U.S. Pat. No. 4,768,766 discloses a system having a main control data processor, a magnetic tape reader and associated disc storage memory for coded address and message data, control information, etc. and an operator terminal. The system also includes a bindery line with means for selective gathering of signatures, and for ink-jet printing the magazine with an address or personalized messages; a line control data processor and an operator terminal connected with the bindery line to control signature selection and imaging; and a communication network for transmitting data and control information from the main control to the line control. This system utilizes one on-line printing station having one or more ink jet heads for printing a message on a selected signature. A second on-line printer, downstream of the first on-line printer, is employed to image a name and address on the label area of the book or magazine cover.

U.S. Pat. No. 4,121,818 discloses a signature collating and binding system wherein a non-contact printer (such as an ink jet type) is located within the collating line, between adjacent signature feeders, to custom print information on the signature in response to coded signals also used to actuate the feeders. Downstream feeders then deliver additional signatures over the custom printed signature. After binding, a second non-contact printer, located downstream of a trimmer, prints mailing labels under control of the coded signals.

U.S. Pat. No. 3,917,252 discloses a computer controlled system for producing differently constituted magazines tailored to the characteristics of particular subscriber groups within the total magazine subscription. A conventional signature feeding or gathering machine is used in conjunction with a chain conveyor for providing predetermined combinations of signatures for different subscriber groups.

U.S. Pat. Nos. 4,493,482; 4,395,031; and 4,149,711 (and corresponding Reissue U.S. Pat. No. Re. 31,710) disclose additional systems utilizing on-line ink jet printers for applying customized, personal data to magazine signatures.

Existing methods are substantially limited, however, in their ability to produce high-quality personalization. The customized signatures used in selective binding can be pre-printed on four-color presses for a high-quality appearance, but the ability to customize the magazine in this way is severely limited by the number of selective hoppers in the bindery line—ten to twenty versions is the practical limit on most bindery lines.

On-line personalization, on the other hand, offers an unlimited number of variations—each individual magazine can be printed with unique information. Because the printing heads must be mounted on-line in the bindery line, however, there are numerous constraints which limit the quality and extent of the personalized printing that can be achieved. Presently known on-line ink jet heads print only small areas (usually limited to a one-inch-high strip) at low-resolution (usually only 60 to 100 dots per inch). This results in a small, low-quality printed image with little or no ability to produce fonts, graphics or halftone images. Larger, higher-quality printing heads capable of operating on-line in the bindery line are under development, but they will continue to be inferior to off-line personalized printing devices.

Off-line personalized printing devices include wide-bar and higher-resolution ink jet printers, hot- and cold-fusion laser printers, electrostatic printers, and various other technologies, both existing and under development. These printers operate independently and cannot practically be operated on-line in the bindery line. But these printers can personalize larger areas with higher-quality images (often including graphics and halftones) at higher speeds and lower costs.

It is presently known to personalize signatures on off-line printers and bind these "pre-personalized" signatures onto a magazine as an "outsert" (an extra signature wrapped around the outside cover of a magazine). Such outserts are used, for example, to deliver subscription renewal forms to subscribers whose expiration date is near. Such outserts are simply loaded into the last hopper on the bindery line, and carry the address label pre-printed on the pre-personalized signature itself.

However, it is not presently known to bind such pre-personalized signatures inside the covers of a magazine. The reason is that there is no current method on the bindery line to reliably match a pre-personalized signature bound inside the covers with the address information attached or printed on the cover. In other words, if a particular pre-personalized signature has John Doe's name on it and is bound inside a magazine, there is no reliable way to get John Doe's address on the cover. (In the case of on-line personalization, the personalized printing is controlled by the bindery line controller, which subsequently tracks the location of the personalized signature throughout the bindery process and applies the appropriate address at the addressing station. In the case of off-line personalization, however, the bindery line controller does not know what information is printed on any particular pre-personalized signature.

The present invention provides a unique manner of reliably matching pre-personalized signatures bound inside the covers of a magazine with the appropriate address information to be printed on its cover. This allows a dramatic increase in the amount and quality of personalized information and images that can be incorporated into a magazine.

A primary feature of the invention involves the installation of a recognition device on the bindery line which is capable of reading identifying marks or codes printed on each pre-personalized signature. These codes are then communicated to a central processor which converts them into address information, either through a translation process or through a look-up process against a stored address file. The address information is then communicated to an on-line printing head at the addressing station which prints the address on the cover.

In one exemplary embodiment of the invention, an off-line variable printer is used to print personalized information onto forms (which may also have been pre-printed with non-personalized four-color images). These forms are cut and folded into pre-personalized signatures, which customarily consist of one sheet of paper folded once and printed on both sides to make up four printed pages in the magazine, but which could also consist of eight or more printed pages. The signatures are produced in proper distribution sequence to maintain optimum postal sortation, then stacked and delivered to the bindery line (which may be at a different facility), where they are loaded into the appropriate hopper (which could be in any hopper location) for insertion at the desired location vis-a-vis other non-personalized signatures in the bindery line.

There remains the problem of applying to the cover of each magazine the recipient's name and address which corresponds to the pre-personalized signature bound inside that magazine. This invention addresses the problem in a unique a relatively simple manner. A recognition device such as a scanner, camera or other symbol-reading device (and utilizing any one of numerous available recognition technologies such as OCR scanning or bar code reading) is positioned on the pre-personalized hopper or on the bindery line downstream from the pre-personalized hopper. It reads a code printed on the pre-personalized signature. The code can be in any location on the pre-personalized signature which is visible to the recognition device, but the preferred location is the lap area of the signature which will be trimmed off later in the bindery process, thus improving the aesthetics of the magazine. The code can be in any one of numerous forms: 1) the full address information, such as a full OCR-scannable name and address printed on the pre-personalized signature, 2) a compressed code that can be translated into the full address information using decoding algorithms, or 3) a match code that can be compared to a look-up table of addresses stored in the memory of the central processor.

In a bindery line with selective binding capabilities, the code is communicated to the conventional control processors, which are equipped with special software which allows them to convert the code into full address information either through algorithms or look-up against an address file stored in high-speed memory. Meanwhile, the magazine continues along the bindery line, through the conventional caliper, reject and stitch and trim stations. Properly assembled magazines (as opposed to rejects) are then transferred to a table where they are trimmed and addressed.

The line control processor tracks the position of each pre-personalized signature as it moves through the bindery line and instructs a conventional on-line ink jet printing head at the addressing station to print the matching address information on the cover or address carrier.

In a selective bindery line implementation, pre-personalized signatures can be mixed with conventional customization (selective binding) and personalization (on-line ink jet personalization inside the magazine) at any point downstream of the pre-personalized signature feeder, if desired.

A second simplified embodiment of the invention relates to a non-selective bindery line where signatures are automatically fed in sequence from all of the hoppers, as determined by a mechanical connection to the bindery chain and associated drive shaft. In such a system, the otherwise complex bindery controls which selectively fire individual hoppers based on a master customization scheme can be eliminated. In this embodiment, which is particularly adapted for use in a saddle stitch binding process, one hopper will be supplied with pre-personalized signatures, printed off-line as described above, and including bar code or other machine readable indicia along an edge to be trimmed. A stand-alone CPU (for example, any suitable "personal computer") can be located along the bindery line to control the various stations and devices along the bindery line, downstream of the signature feeders, i.e., after assembly of the magazine is completed. These stations may include a calipering (inspection) station, a plough station, a bar code (or other) reader, an ink jet printer for cover addressing, a bundle break mark applicator, a reject station and a reject label printer. The CPU will include a data file containing address information matched to the bar codes on the signatures, as well as a reject label file as described further herein.

In this second embodiment, the plough station apparatus (which is well known in the art and typically used for insertion of cards or other inserts at preselected locations) will open the signature to permit the bar code reader to record the bar code information. The signature is then closed and the address information subsequently printed on the cover while the magazine is still on the bindery chain conveyor (and before it reaches the mailing table so the CPU can easily track its position by monitoring the speed of the bindery chain).

In an even more simplified third embodiment of the invention, readily usable in both saddle stitch and perfect binding processes, pre-personalized signatures are added in the signature position which is inserted immediately inside the cover signature. These pre-personalized signatures are printed with the desired personalization information as well as the subscriber name and address and perhaps other control information. At the same time, the cover signature is provided with a die-cut window which, when assembled in place, will overlie the address and other control information on the underlying pre-personalized signature, thus making the address visible when the cover is closed. This arrangement eliminates the need for on-line address printing, but is otherwise limited in application by virtue of the necessary location of the pre-personalized signature immediately adjacent the cover and the necessary die cut in the cover.

Another aspect of the present invention relates to the ability to identify, sort and handle rejects within the bindery line in both selective and non-selective binding operations. One conventional inspection technique for magazines in the bindery process utilizes finely tuned calipers downstream of the signature gathering operation for measuring the magazine thickness. In the event one or more signatures are missing, or if one or more unwanted signatures have been inserted, the calipers will detect a deviation from a predetermined reference thickness, and the magazine will be diverted from the bindery line and discarded.

A further complication is introduced, however, where a personalized intermediate signature has been introduced into the magazine in a selective binding operation. Specifically, a magazine having a pre-personalized signature may be rejected, and ejected prior to the address printing step. One partial solution to the problem is to locate a first set of calipers upstream of the pre-personalized signature hopper so as to provide an initial screening based on a predetermined intermediate magazine thickness. Since there may only be a few inserts and/or signatures to be added downstream of this first set of calipers, this arrangement will screen out a significant portion of the total number of rejects in the batch. In any case, additional reject handling techniques are necessary to insure high quality control vis-a-vis the finally assembled magazine.

In the selective binding process, as in the first described embodiment, in the event a magazine is rejected as a result of a final caliper check of predetermined magazine thickness, that magazine is ejected from the bindery line, and, in accordance with the invention, a non-personalized magazine is automatically re-ordered for receiving the reject address information on-line.

In the non-selective binding process, as in the second described embodiment, the bar code (or other) reader is actuated to read the pre-personalized address on every magazine (both on properly-assembled and on reject magazines) prior to ejection of the rejects from the bindery line. No address information is printed on the rejects, however, since the printer (via the CPU) knows the corresponding magazine is incomplete and will be rejected. The reject is subsequently ejected from the bindery line and all rejects can then be re-done as non-personalized re-makes, with address information retrieved from the reject label file within the local CPU.

In the third described embodiment, rejects may be handled simply by manually re-feeding the pre-personalized signatures from the rejected magazines into the pre-personalized signature hopper for use in assembling replacement magazines. Alternatively, the address on the rejected pre-personalized signatures may be machine-read to initiate printing of new, self-adhesive labels which can then be attached to non-personalized versions of the magazines.

From the above, it will be appreciated that the present invention provides simplified yet higher quality personalization of magazines with accurate and intelligent correlation of the personalization information with address information applied to the magazine cover.

Thus, in accordance with broader aspects of the invention, there is provided a process for the assembly of magazines in a bindery line wherein individual signatures are deposited on a conveyor from a plurality of hoppers, the improvement broadly comprising the steps of:

a) pre-personalizing off-line signatures with personalization information including machine readable indicia;

b) loading the pre-personalized signatures into at least one of the plurality of hoppers;

c) depositing the pre-personalized signatures on the conveyor between other of the individual signatures from adjacent hoppers;

d) providing a symbol reading device for reading the machine readable indicia and generating address information including recipient name and address matched to the personalization information; and e) printing on-line the address information on cover signatures of the respective magazines.

In another aspect, the invention provides apparatus for assembling magazines wherein selected signatures are deposited from a plurality of hoppers onto a conveyor, the improvement broadly stated comprising: first means for pre-personalizing at least one group of signatures with personalization information, at least a portion of which is in the form of coded indicia, prior to insertion of the one group in one of the plurality of hoppers; second means for reading the coded indicia after the one group of signatures has been inserted in one of the plurality of hoppers; third data processing means for storing at least label information including subscriber name and address and for matching the coded information to the label information or for directly translating such coded information into label information; and fourth means for printing the label information on covers of the magazines.

Other objects and advantages of the invention will become apparent from the detailed description which follows.

DETAILED DESCRIPTION OF THE DRAWINGS

As described in U.S. Pat. No. 4,768,766 mentioned above, (the disclosure of which is incorporated by reference), and by way of background, a typical magazine assembly system for use in a selective binding process may include a main controller for controlling a plurality of substantially identical bindery lines. The main controller will typically include a data processor, an operator terminal including a monitor for display of message and program menus and for entry of information or instructions by the operator. A magnetic tape reader and a disc storage memory are also connected to the main controller. The main controller is preferably located at a point remote from the bindery lines and may be in an environmentally controlled room. It will be appreciated, of course, that the assembly system may include many independently controlled bindery lines.

Figure 1:
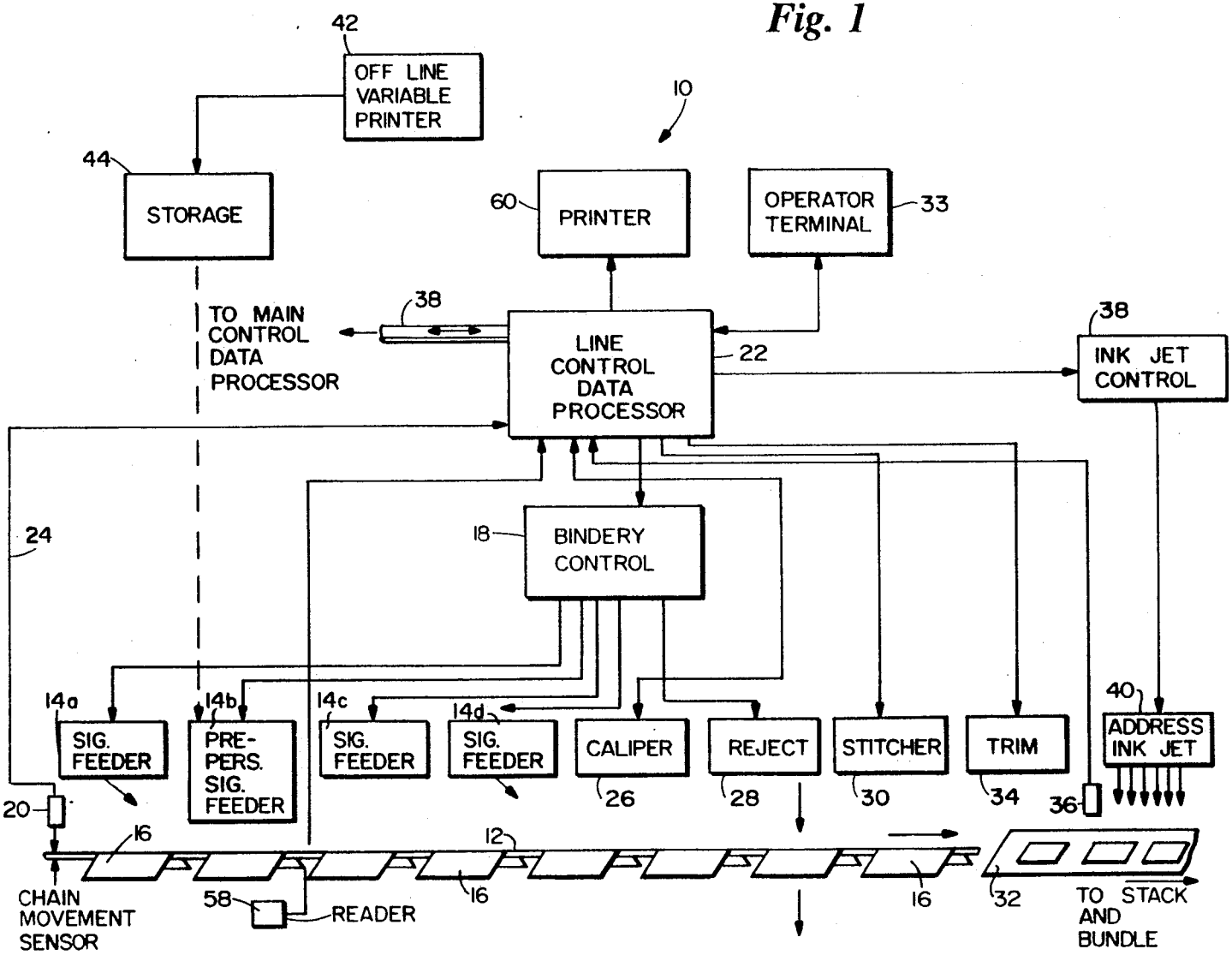
FIG. 1 is a schematic diagram of a part of a bindery line and related controls in accordance with a first exemplary embodiment of the invention.

With specific reference to FIG. 1, a selective saddle stitch bindery line 10 for customized magazines (shown in abbreviated form) has a moving chain 12 on which component portions of the magazine are assembled in the usual fashion. The chain conveyor, or chain, moves past a plurality of signature delivery feeders or hoppers 14*a, b, c* and *d* from which pre-printed signatures 16 are fed to, and deposited on the chain 12. The manner in which the signatures are selectively fed to the chain, based upon predetermined customization requirements, is governed by the bindery control 18 and a main control data processor (indicated but not shown) in a manner which is well understood in the art, and as described, for example, in U.S. Pat. No. 4,768,766 and other patents referenced therein. The chain 12 is driven by a motor 20 and a signal representing chain movement is coupled to the line control data processor 22 as indicated by line 24. The chain 12 is provided with a plurality of defined spaces for receiving selected signatures in succession.

Signature feeders or hoppers 14*a, b, c* and *d* deliver signatures to the chain as each magazine position on the chain passes the respective hoppers. Four signature feeders or hoppers are shown, but it will be appreciated that a typical bindery line may have as many as 12–30 (or more) signature feeders.

During selective assembly of a magazine, vacuum type or other suitable valves or other mechanisms control the signature feeders which are selectively fired to direct appropriate signatures to an assigned chain space.

After a final chain position for a magazine has passed the last of the signature feeders, a caliper 26 senses the thickness of the magazine and the thickness signal is coupled to the line control data processor 22. If the magazine thickness is outside a pre-selected reference thickness, the magazine is rejected and diverted from the chain at reject station 28.

Correctly assembled magazines are stapled at a stitcher 30 and are then removed from the chain 12 and transferred to a conveyor table 32 where the edges are trimmed at 34. Thereafter, sensors 36 detect the presence of a magazine and data processor 22, through the ink jet control 38, initiates operation of an ink jet printer 40 to image a name and address on the label area of the magazine cover signature.

The completed magazines continue to a stacking and bundling station (not shown). Typically, the magazines are assembled in bundles by zip code and in numbers which take advantage of postal discounts, and this is accomplished by use of bundle break marks applied in the label area along with the subscriber name and address information.

The above described system is fairly typical of the prior art as described in U.S. Pat. No. 4,768,766, and the specific improvement to the selective binding process in accordance with this invention is described below.

In accordance with a first exemplary embodiment of the invention, and referring again to FIG. 1, pre-personalized signatures are printed off-line by a variable printer 42 which may be, for example, a printer manufactured by A.M. Graphics under the name "THE ELECTROPRESS". A variable printer of this type can provide full page black plate personalization across both sides of an entire sheet which, after folding and slitting, will form four separate personalized pages. Alternatively, two of the four pages (if the two are from the same side of the sheet) can be personalized in two colors each with the above identified printer.

Alternative variable printers including laser, and even ink jet (wide or narrow head) can be used for the off-line pre-personalization of signatures. Once the signatures have been pre-personalized off-line, they may be moved to a storage area 44 where they may be held until they are required for a particular job order. At that time, the pre-personalized signatures are moved to the bindery system location and signatures are loaded into a preselected signature feeder or hopper, for example, that designated by numeral 14*b*, from which they are selectively deposited on the chain 12 under the control of bindery control 18.

As noted above, the pre-personalized signatures can be part of a personalization scheme per se (using otherwise standard signatures), or part of a combined customization/personalization scheme (using customized signatures), depending on the overall master program for a particular job.

Figure 2:
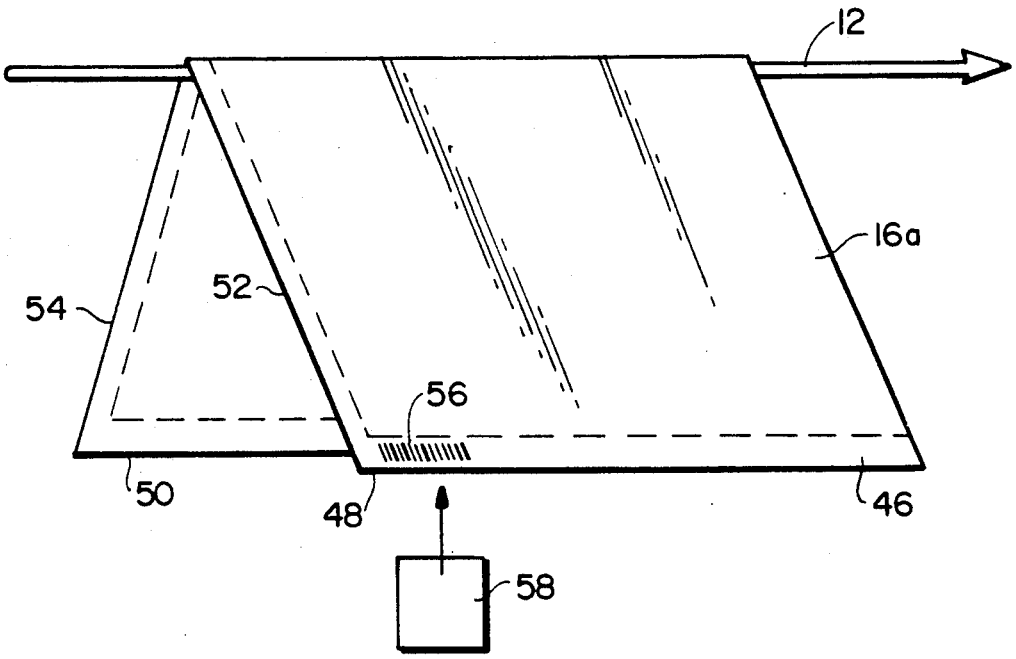
FIGS. 2 and 2A are enlarged details of alternative bar code reading arrangements for use in the bindery line of claim 1.

With additional reference to FIG. 2, the personalized signature 16*a* includes a marginal area 46 to be trimmed which extends along horizontal edges 48 and 50 as well as vertical edges 52 and 54. A bar code (or other suitable machine readable indicia) 56 is printed within the marginal area 46 to be trimmed adjacent the edge 48. This is done off-line, concurrently with the printing of other personalization information by the printer 42. After the pre-personalized signature 16*a* has been deposited on the chain 12, a bar code reader 58 (or other reader device consistent with OCR or other image scanning techniques) located in close proximity to the edge 48 reads and transmits the bar code information, which is keyed to the pre-personalization data on the signature 16*a*, so that the processor 22 can communicate the necessary, matched address information contained in the storage memory of the main control data processor to the ink jet control 38. Thus, the appropriate matched name and address can be applied to the magazine cover signature by the ink jet printer 40.

Figure 2A:
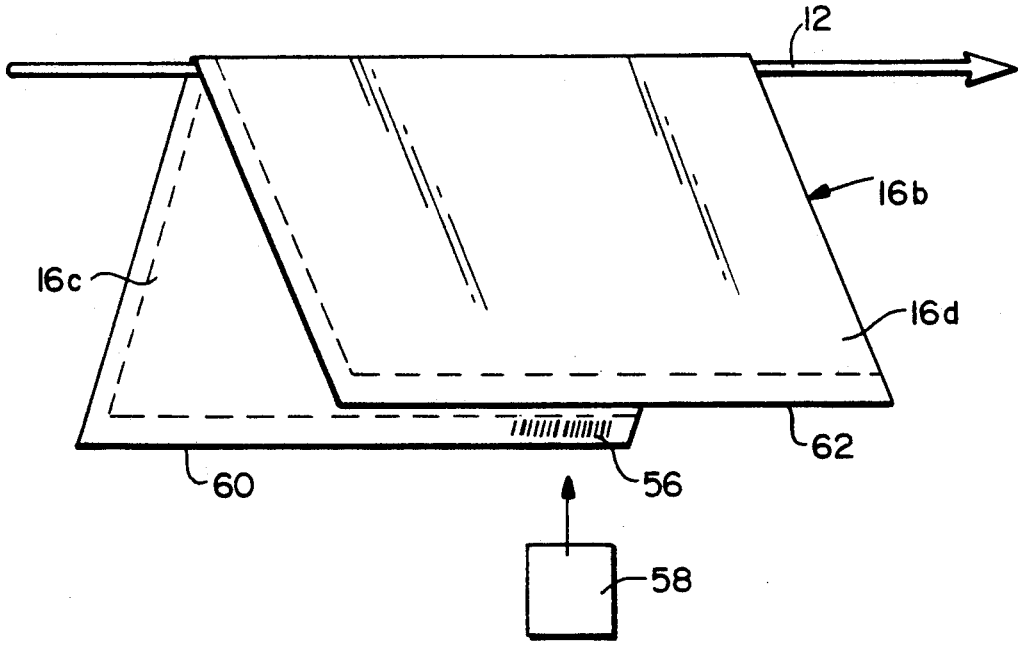

In an alternative arrangement illustrated in FIG. 2A, the signature 16*b* has a trimmable flap portion 60 which extends downwardly from one sheet portion 16*c* beyond the edge 62 of the adjacent sheet portion 16*d* of the signature, thereby facilitating the reading of the bar code 56 by the reader 58.

It is also possible in accordance with this invention, to locate the reader device at the appropriate signature feeder 146 to permit reading of the bar code or other indicia prior to deposit of the pre-personalized signatures on the chain 12.

For those magazines which do not comply with a reference thickness as determined by caliper 26, ejection from the bindery line is effected at reject station 28. Since the reader 58 will have already read the bar code or other indicia 56, the printer 40 will know that the rejected magazine is absent from the bindery line. A non-personalized magazine is automatically re-ordered, and this magazine will receive, on-line, the address information previously withheld as a result of the rejection. In this way, the integrity of the bindery line and the particularly scheduled job is maintained, with each magazine having the required signatures (one signature feeder or hopper will have non-personalized signatures therein which are otherwise identical to the pre-personalized signatures specifically for use in reject handling), but with a small percentage, corresponding to the percentage of rejects, being non-personalized.

For those magazines which pass the caliper inspection station 26 without rejection, additional conventional processing occurs at the stitcher 30 and trimmer 34 prior to address printing by the printer 40. Typically, a bundle break mark is also applied by the printer 40 so that, during subsequent stacking, a conventional bundle break mark reader will serve to group the magazines into bundles in accordance with postal sortation information.

It will be understood that the invention as described above in connection with saddle stitch binding, has equal applicability to conventional perfect binding.

Figure 3:
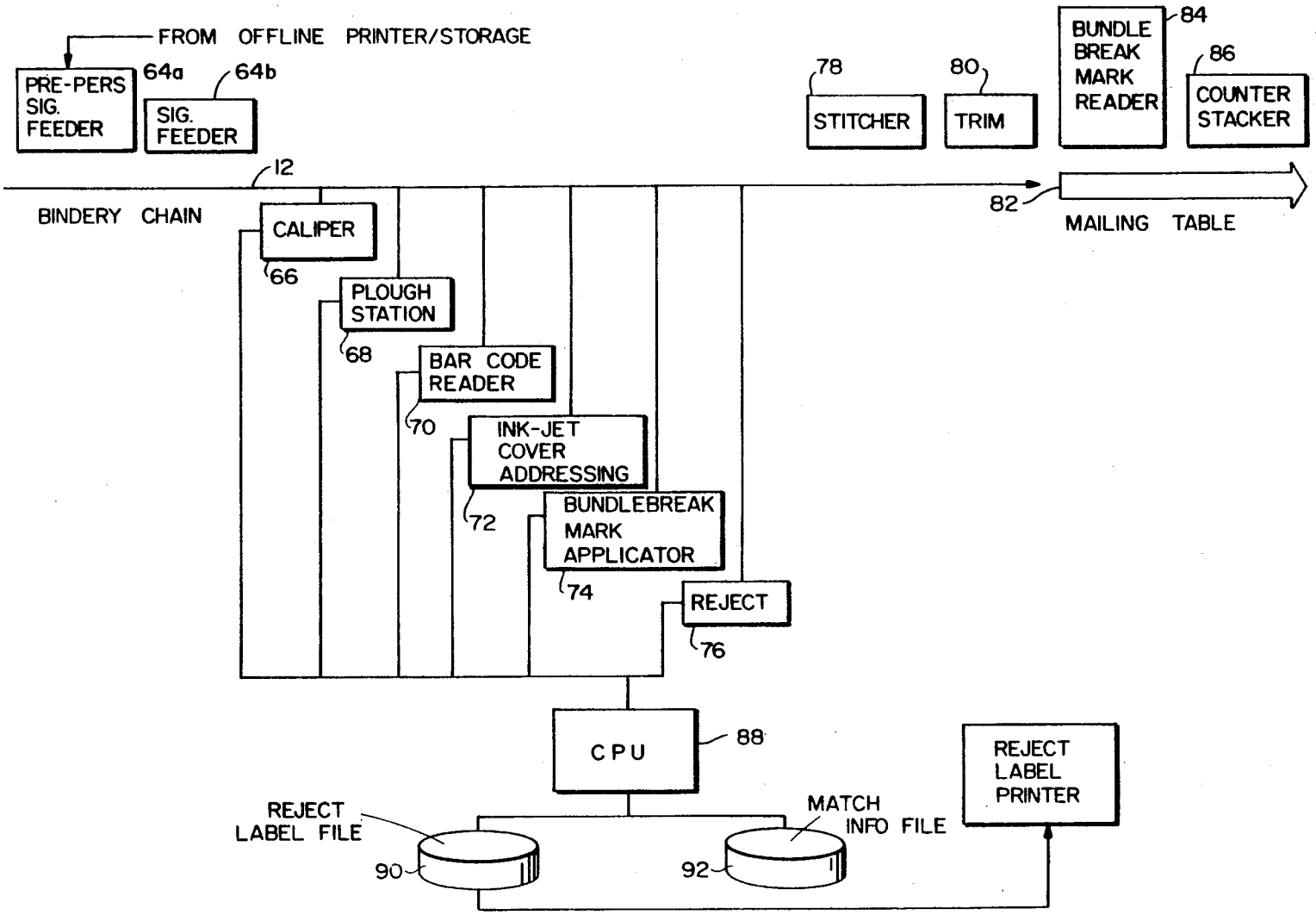
FIG. 3 is a schematic diagram of a part of a bindery line and related controls in accordance with a second exemplary embodiment of the invention.

With reference now to FIG. 3, a simplified alternative embodiment of the invention is illustrated, relating to a stand-alone implementation of the invention, specifically for use in a non-selective bindery line of the saddle stitch type. In a non-selective binding process, no bindery control system is necessary since the signature feeders are controlled by mechanical connection to the chain and drive shaft, and a signature will be deposited on the chain from each of the feeders. In other words, except for the pre-personalized signatures, the magazines will be identical. One of the signature feeders or hoppers 64*a* will supply pre-personalized signatures with bar codes or other machine readable indicia printed thereon as described above. The location of the pre-personalized signature feeder 64*a* adjacent the last signature hopper 64*b*, is exemplary only, and it will be appreciated that, as in the case of FIG. 1, only a portion of the bindery line is shown in FIG. 3. Generally speaking, the pre-personalized signatures may be inserted between any two adjacent signatures along the bindery chain 12.

Upon completion of the signature feeding operation, the magazine will pass the caliper station 66 and arrive at a plough station 68 where the pages of the magazine are partially opened to permit the bar code (or other) reader 70 to read the bar code on the pre-personalized signature. Plough stations of this type are well known in the art and need not be described in detail here. They are typically employed to open signatures to permit insertion of subscription cards and the like at selected locations within the magazine. After reading the bar code or other indicia, the pages are allowed to close, and an ink jet printer 72 is actuated to print the subscriber name and address information on the cover of the magazine. After the address information has been printed, the magazine passes through a bundle break mark applicator 74, a reject station 76, a stitcher 78, a trimmer 80 and then onto a mailing table 82 where the magazines are transported past a bundle break mark reader 84 and a counter/stacker 86 controlled by the reader 84.

The caliper, plough station, bar code reader, ink jet printer, bundle break mark applicator and reject station communicate with a stand-alone CPU 88 incorporating a reject label file 90 and an address match information file 92. In this simplified version of the invention, the CPU 88 will receive information from the bar code reader 70 and, after searching the address match information file 92, will actuate the ink jet printer 72 to apply the matched subscriber name and address information and the bundle break mark applicator 74 to apply appropriate bundle break marks on the magazine cover. The subsequent operations carried out by stitcher 78 and trimmer 80 can be controlled by the usual mechanical-/electrical connection to the chain 25 and associated drive shaft (not shown).

In the event the caliper 66 detects a magazine having more or less than the predetermined set number of pages, this information will be transmitted to the CPU 88 and appropriate signals will be generated which will permit the plough station 68 and bar code reader 70 to operate in the normal way, but will prevent the ink jet printer 72 from applying the subscriber name and address information on the cover of the rejected magazine. The rejected magazine will then be ejected at the reject station 76. In this non-selective binding process, the non-printed address information is stored in the reject label file 90 and non-personalized re-makes for all of the rejected magazines can be addressed by reject label printer 94 in sequence, after the primary job run is completed.

Figure 4:
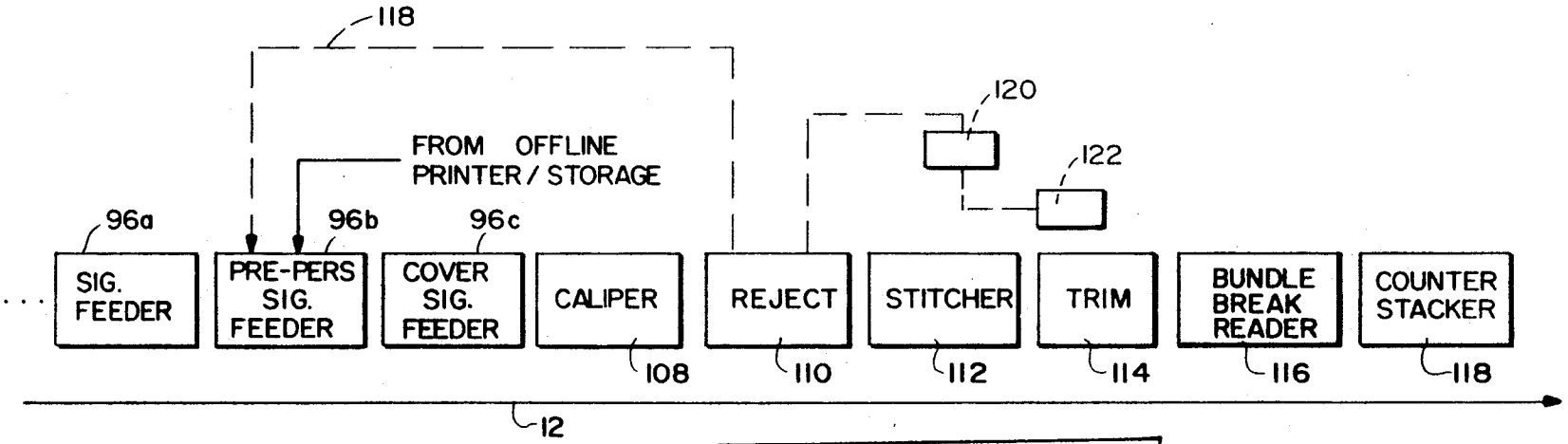
FIG. 4 is a schematic diagram of a bindery line in accordance with a third exemplary embodiment of the invention.
Figure 4A:
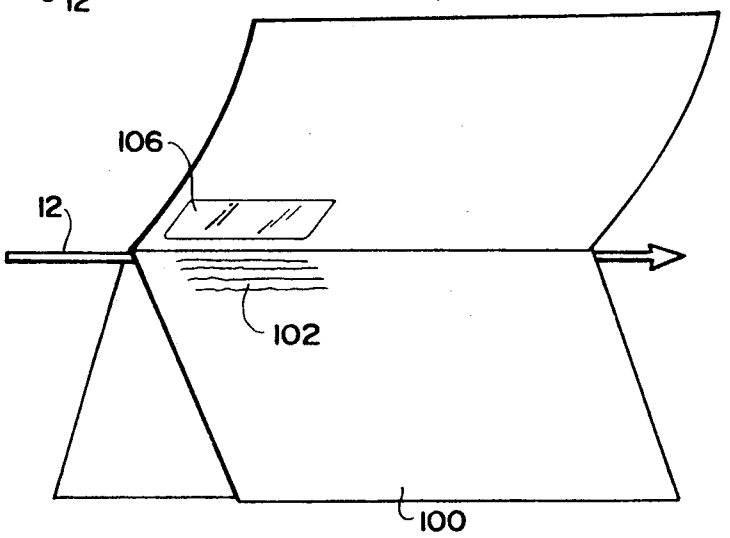
FIG. 4A illustrates a cover signature overlying a pre-personalized signature in accordance with the third exemplary embodiment illustrated in FIG. 4.

With reference now to FIGS. 4 and 4A, still another and even more simplified embodiment of the invention is illustrated in the context of a saddle stitch binding process. It will be appreciated that the embodiment described below is also applicable to perfect binding processes.

A pre-personalized signature may be deposited on the chain 12 from a hopper 96*b* located between one of many upstream feeders 96*a* and a downstream cover signature feeder 96*c*. This pre-personalized signature 100 is also personalized off-line and, if necessary, stored as described hereinabove. The significant aspect of this embodiment is the outright elimination of the need for matching the pre-personalized signature to address information on the cover. This is achieved by providing address information 102 in one portion of the personalized signature 100 and by positioning the pre-personalized signature 100 immediately upstream of the cover signature. In addition, the cover signature 104 is die cut to provide a window 106 which will overlie the address information 102 supplied on the pre-personalized signature 100. After the magazine has been assembled on the chain 12, it is processed through a caliper station 108, reject station 110, stitcher 112, trimmer 114, bundle break reader 116 and counter/stacker 118.

This is a fairly simple way to utilize off-line printed pre-personalized signatures, eliminating the present limitations of narrow head ink jet printers, but without having to provide additional bar code or other reader devices to insure matching of the pre-personalized signatures and address information. A limitation on this version, of course, is that the pre-personalized insert must be the first or last page of the magazine, adjacent the front or rear sheets of the cover signature, and that the cover must be die cut.

Rejects in this third exemplary embodiment of the invention may be handled by ejecting the rejects at station 110, manually removing the pre-personalized signatures from the rejected magazines and re-feeding them to the feeder 96*b* (as indicated by phantom line 118) for use in subsequently assembled magazines. Alternatively, a reader 120 may be provided to read the address information on the pre-personalized signatures removed from the rejected magazines. This information is then used to control the printing of new self-adhesive labels by a printer 122 which are subsequently applied to non-personalized re-makes of the rejected magazines.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. In a process for the assembly of magazines in a bindery line wherein individual signatures are deposited on a conveyor from a plurality of hoppers, the improvement comprising the steps of:

a) pre-personalizing off-line signatures with personalization information including machine readable indicia;

b) loading the pre-personalized signatures into at least one of said plurality of hoppers;

c) depositing the pre-personalized signatures on the conveyor between other of said individual signatures from adjacent hoppers;

d) providing a symbol reading device for reading said machine readable indicia and generating address information including recipient name and address matched to said personalization information; and e) printing on-line said address information on cover signatures of the respective magazines.

2. The process of claim 1 wherein the bindery line includes a line control data processor connected to a bindery control for controlling selection and assembly of signatures in accordance with pre-established selective binding control information, and to a storage memory containing recipient name and address information and wherein, during step d), the data processor is accessed via said symbol reading device to locate address information keyed to said machine readable indicia.

3. The process of claim 2 wherein said individual signatures include standard signatures and customized signatures and step a) is carried out by personalizing at least one standard signature.

4. The process of claim 2 wherein said individual signatures include standard signatures and customized signatures and step a) is carried out by personalizing at least one customized signature.

5. The process of claim 1 wherein step a) is carried out utilizing any one of an ink jet printer, a laser printer or a xerographic electropress printer.

6. The process of claim 1 wherein step e) is carried out with an ink jet printer.

7. The process of claim 1 wherein said machine readable indicia comprises a bar code or OCR characters.

8. The process of claim 7 wherein said symbol reading device comprises a camera.

9. The process of claim 7 wherein during step a), said bar code is applied to a marginal edge of the pre-personalized signature.

10. The process of claim 1 including, between steps d) and e), the steps of inspecting the magazines upon assembly of all signatures and ejecting any rejects from the bindery line, and thereafter assembling non-personalized replacement magazines and printing label information corresponding to the pre-personalized signatures of the rejects.

11. The process of claim 2 wherein between steps d) and e), calipering, rejecting, stitching and trimming steps are carried out.

12. In a process for the assembly of magazines in a bindery line wherein individual signatures are deposited on a conveyor from a plurality of hoppers, the improvement comprising the steps of:

a) pre-personalizing off-line signatures with personalization information including machine readable indicia;

b) loading the pre-personalized signatures into at least one of said plurality of hoppers;

c) depositing the pre-personalized signatures on the conveyor between other of said individual signatures from adjacent hoppers;

d) providing a symbol reading device for reading said machine readable indicia and generating address information including recipient name and address matched to said personalization information; and e) printing on-line said address information on cover signatures of the respective magazines, wherein the magazines are non-selectively assembled, using signatures from each of said plurality of hoppers, the bindery line including in sequence, and following said plurality of hoppers. at least a caliper, a symbol reader and a printer, each of which is in communication with a central processor unit for the bindery line, said central processor unit having at least a subscriber name, address and other control information file, and a reject label file.

13. The process of claim 12 and wherein a bundle break mark applicator and reject station are located downstream of said printer and also in communication with the central processor unit.

14. The process of claim 12 wherein step a) is carried out utilizing any one of an ink jet printer, a laser printer or a xerographic electropress printer.

15. The process of claim 12 wherein step e) is carried out with an ink jet printer.

16. The process of claim 12 wherein said machine readable portion comprises a bar code, OCR characters, or other machine readable indicia.

17. The process of claim 12 wherein said symbol reading device comprises a camera.

18. The process of claim 16 wherein during step a), said bar code is applied to a marginal edge of the pre-personalized signature.

19. The process of claim 18 wherein after step e), said marginal edge is trimmed from the pre-personalized signature.

20. The process of claim 12 wherein said caliper is utilized to measure thickness of the magazine and said central processor unit compares the measured thickness to a reference thickness and if different, the magazine is rejected.

21. The process of claim 20 wherein, in the event of a reject, the symbol reader is actuated following the calipering operation, but the printer is prevented from actuating, and information read by the symbol reader is stored in the reject label file.

22. The process of claim 21 wherein non-personalized magazines are assembled to replace said rejects, said non-personalized magazines being printed in step e) with labels from said reject label file.

23. A process for producing magazines including one or more subscriber pre-personalized signatures, and a cover provided with corresponding recipient name and address information comprising the steps of:

a) providing a plurality of adjacent hoppers, each holding a different set of signatures;

b) providing a conveyor proximate the hoppers for receiving signatures from said hoppers to thereby establish a bindery line;

c) providing a data processor including a memory for storing information including recipient name and address;

d) printing selected signatures with personalized information off-line at a location remote from said bindery line, said personalized information including a bar code including information keyed to the recipient information in the data process memory;

e) inserting said pre-personalized signatures in a selected one of said plurality of hoppers for deposit on said conveyor;

f) reading said bar code or other machine readable indicia and communicating the bar code information or information taken from other machine readable indicia to the data processor for matching with said recipient information; and g) downstream of said hoppers, printing said recipient name and address information, on-line, on said cover.

24. The process of claim 23 wherein said bar code is located along marginal edges of said pre-personalized signatures.

25. The process of claim 23 wherein step d) is carried out utilizing one of a wide-bar ink jet printer, a laser printer or a xerographic electropress printer.

26. The process of claim 24 wherein said marginal edges are subsequently trimmed from said pre-personalized signatures.

27. The process of claim 23 wherein step f) is carried out before said pre-personalized signatures are deposited on the conveyor.

28. In a process for the assembly of magazines in a bindery line wherein individual signatures are deposited on a conveyor from a plurality of hoppers, the improvement comprising the steps of:

a) pre-personalizing signatures off-line with personalization information including recipient name and address;

b) loading the pre-personalized signatures into one of said plurality of hoppers;

c) providing cover signatures with windows formed therein in a hopper adjacent and downstream of said one of said plurality of hoppers; and d) depositing the pre-personalized signatures and the cover signatures on the conveyor so that said windows overlie the recipient name and address on the pre-personalized signatures.

29. The process of claim 28 wherein, following step c), the magazines are inspected for compliance with a predetermined reference thickness, and those magazines in non-compliance are ejected from the conveyor, and wherein the pre-personalized signatures are removed from the rejected magazines and re-loaded into said one of said plurality of hoppers.

30. The process of claim 28 wherein, following step c), the magazines are inspected for compliance with a predetermined reference thickness and those magazines in non-compliance are ejected from the conveyor, and wherein the pre-personalized signatures are removed from the rejected magazines and the recipient name and address are read by a symbol reading device operatively connected to a printer, and further wherein labels including the recipient name and address are printed and applied to non-personalized replacement magazines.

31. Apparatus for assembling magazines including a bindery line wherein selected signatures are deposited from a plurality of hoppers onto a conveyor, the improvement comprising:

first means remote from said bindery line for pre-personalizing at least one group of signatures with personalization information, at least a portion of which is in the form of coded indicia, prior to insertion of said one group of signatures into one of said plurality of hoppers such that said one group of signatures will be deposited on the conveyor between signatures from other hoppers;

second means for reading said coded indicia after said one group of signatures has been inserted in one of said plurality of hoppers;

third data processing means for storing at least label information including subscriber name and address and for matching information generated by said coded indicia to said label information; and fourth means for printing said label information on cover signatures of said magazines.

32. The apparatus of claim 31 wherein said first means comprises one of a wide bar ink jet printer, a laser printer or a xerographic electropress printer.

33. The apparatus of claim 31 wherein said coded indicia comprises a bar code.

34. The apparatus of claim 33 wherein said second means comprises a symbol reader.

35. The apparatus of claim 34 wherein said symbol reader comprises a camera.

36. Apparatus for non-selective binding of magazines comprising a bindery line including a plurality of signature feeders, at least one of said signature feeders adapted for holding pre-personalized signatures provided with machine readable indicia, and another of said feeders adapted for holding cover signatures, a bindery conveyor adjacent said signature feeders for receiving signatures from said feeders; and in sequence and downstream of said signature feeders along said bindery conveyor, a caliper station, a plough station, a symbol reader station for reading said machine readable indicia and an address printer station; and data processor means including an information file containing recipient name and address information for correlating said machine readable indicia via data transmitted from said symbol reader station and said recipient name and address information in said information file.

37. Apparatus according to claim 36 and including a plough station upstream of said symbol reader station for opening assembled magazines to said pre-personalized signatures to thereby enable said machine readable indicia to be read at said symbol reader station.

38. Apparatus according to claim 36 and including a bundle break mark applicator station downstream of said address printer station.

39. Apparatus according to claim 38 and including a reject station downstream of said bundle break mark applicator station.

40. Apparatus according to claim 39 wherein each of said caliper station, plough station, symbol reader station, address printer station, bundle break mark applicator station and reject station are controlled by said data processor.

41. Apparatus according to claim 39 wherein said data processor includes a reject label file, and wherein said apparatus includes an off-line reject label printer controlled by said data processor.

42. Apparatus according to claim 36 and further including an off-line printer for printing personalized information including said machine readable indicia on said pre-personalized signature.

43. Apparatus according to claim 42 wherein said off-line printer comprises a xerographic electropress printer.

44. In a process for the assembly of magazines in a bindery line wherein individual signatures are deposited on a conveyor from a plurality of hoppers, the improvement comprising the steps of:

a) pre-personalizing off-line signatures with personalization information including machine readable indicia;

b) loading the pre-personalized signatures into at least one of said plurality of hoppers;

c) depositing the pre-personalized signatures on the conveyor between other of said individual signatures from adjacent hoppers;

d) providing a symbol reading device for reading said machine readable indicia and generating address information including recipient name and address matched to said personalization information;

e) printing on-line said address information on cover signatures of the respective magazines; and f) trimming said machine readable portion from the pre-personalized signature.

45. A process for producing magazines including one or more subscriber pre-personalized signatures, and a cover provided with corresponding recipient name and address information comprising the steps of:

a) providing a plurality of adjacent hoppers, each holding a different set of signatures;

b) providing a conveyor proximate the hoppers for receiving signatures from said hoppers to thereby establish a bindery line;

c) providing a data processor including a memory for storing information including recipient name and address;

d) printing selected signatures with personalized information off-line at a location remote from said bindery line, said personalized information including a bar code including information keyed to the recipient information in the data process memory;

e) inserting said pre-personalized signatures in a selected one of said plurality of hoppers for deposit on said conveyor;

f) reading said bar code or other machine readable indicia communicating the bar code information or information taken from other machine readable indicia to the data processor for matching with said recipient information; and g) downstream of said hoppers, printing said recipient name and address information, on-line, on said cover;

wherein step f) is carried out after said pre-personalized signatures are deposited on the conveyor.

* * * * *